US005389857A

United States Patent [19]

Abbott et al.

[11] Patent Number: 5,389,857

[45] Date of Patent: Feb. 14, 1995

[54] MAGNETIC BALLAST FOR FLUORESCENT LAMPS

[75] Inventors: Louis E. Abbott; David S. Greenblat, both of Carson City, Nev.

[73] Assignee: Bruce Industries, Inc., Dayton, Nev.

[21] Appl. No.: 65,538

[22] Filed: May 17, 1993

[51] Int. Cl.[6] ..... H05B 39/00

[52] U.S. Cl. ..... 315/94; 315/106; 315/107; 315/224; 315/244; 315/287

[58] Field of Search ..... 315/94, 106, 107, 311, 315/362, 227 R, 241 R, 287, 224, 244, 245

[56] References Cited

U.S. PATENT DOCUMENTS 2,301,891 11/1942 Lecorguillier .

3,170,085 2/1965 Genuit ..... 315/244

4,937,502 6/1990 Pro ..... 315/209 R 5,130,611 7/1992 Johns ..... 315/224

*Primary Examiner*—Robert J. Pascal

*Assistant Examiner*—Haissa Philogene

*Attorney, Agent, or Firm*—Beehler & Pavitt

[57] ABSTRACT

A low component count and lightweight ballast usable with fluorescent lamp loads of widely different wattage has first and second inductors and first and second capacitors connected in a bridge circuit and can provide current regulation within a few percent for lamp loads between 14 Watt and at least 40 Watt. The two inductors can be wound on a single toroidal core for maximum compactness.

23 Claims, 2 Drawing Sheets

MAGNETIC BALLAST FOR FLUORESCENT LAMPS

BACKGROUND OF THE INVENTION

FIELD OF THE INVENTION

This invention relates to ballast circuits used for powering fluorescent tube lamps and in particular concerns a universal type ballast characterized by its simplicity and very low parts count, yet capable of supplying a wide range of loads while maintaining close regulation over the load current.

Fluorescent lamp ballasts may be generally categorized as magnetic ballasts or electronic ballasts. Magnetic ballasts have relatively few components as compared to the more complex electronic ballasts. The latter, however, are capable of very close load current regulation over a wide range of lamp load wattage. Fluorescent lamp tubes are available with various wattage ratings, most commonly from 8 W to 40 W, although higher and lower power lamps are available. A particular lighting installation may call for one or more lamp tubes to be supplied by a single ballast.

It is desirable to have a ballast which is capable of supplying the full range of commonly encountered lamp loads. While relatively simple magnetic ballasts can supply current to a range of lamp loads, the simpler ballast circuits generally provide inadequate regulation of the load current, which results in noticeable and unacceptable variations in light output from the lamp tubes and may also impair the life of the lamp tube. At present, applications requiring close regulation of load current for a wide range of lamp loads tend to use electronic ballasts. Past efforts to design small, lightweight magnetic ballasts of relatively simple configuration and capable of maintaining close current regulation over a wide load range have failed to produce devices which approach the regulation capability of electronic ballasts.

Simple magnetic ballasts have been known for a long time. In its simplest form, a magnetic ballast may consist of a single inductor connected in series with a fluorescent lamp tube. As the current through the lamp increases after striking of the lamp, the impedance of the inductor limits the current through the lamp tube to a safe operating value. Good regulation can be achieved with such an arrangement only with a large and therefore bulky and heavy ballast inductor, and using a high supply voltage, neither of which are practical in most applications. For reasonably sized inductors and commonly available supply voltages the value of the ballast inductor must be adjusted for each particular lamp load.

U.S. Pat. No. 2,301,891 issued to Lecorguillier discloses an inductance/capacitance bridge circuit of a so called constant voltage/constant current type for supplying power to a fluorescent lamp tube. Lecorguillier is concerned with stabilizing lamp operation in order to extend the life of the lamp electrodes under conditions of constant input voltage to the ballast circuit. The Lecorguillier patent, however, completely fails to address the problem of supplying a steady operating current to different lamp loads, and in particular does not recognize any ability of the inductance/capacitance bridge to closely regulate lamp current over a load wattage range of at least three to one. Further, Lecorguillier was unable to achieve stable lamp operation using only the inductance/capacitance bridge circuit. In an effort to overcome this deficiency, Lecorguillier makes use of an additional inductor connected in series with the lamp tube. This additional inductor is undesirable as it adds substantial weight and bulk to the ballast. A simpler solution is needed to achieve stable and dependable operation of the inductance/capacitance bridge circuit without resort to the series inductor. Still further, Lecorguillier neglects to provide an effective filament power supply for the lamp tube which reduces filament power after striking of the lamp tube in order to extend filament life and increase system efficiency.

A continuing need exists for a compact, lightweight magnetic ballast of simple design with few components which is capable of performance approaching or equal to that of electronic ballasts. This need is particularly felt in connection with aircraft passenger cabin lighting systems.

SUMMARY OF THE INVENTION

The present invention addresses the aforementioned need by providing a magnetic ballast of simple design and few component parts yet with load current regulation capability comparable to that of electronic ballasts.

This applicant is the first to recognize that an inductance/capacitance bridge of the type having two sets of inductances and capacitances, each set having one inductance and one capacitance connected across the lamp load, when properly designed, can maintain very close load current regulation over a load wattage range of at least three to one and can replace electronic ballasts in many applications which require such close regulation. One such application is the fluorescent lighting in aircraft, particularly passenger airliners which have extensive cabin lighting installations including many lamp fixtures of varying size depending on their location and purpose.

A given airliner may have fluorescent lamp fixtures of several types, ranging in wattage from a single small fluorescent tube up to fixtures with two large lamp tubes. Typically, the smaller fixtures may have a single 8 W or 14 W tube, while the larger fixtures may use two 40 W tubes for a total lamp load of 80 W.

Clearly, it is desirable from a standpoint of simplicity and economy to provide a single ballast which can be incorporated into all the fluorescent fixtures on the aircraft regardless of the particular wattage of the fixture. The reduction in size and weight of the ballast achieved by this applicant is an important consideration in aircraft lighting applications, while use of the same ballast in all the lamp fixtures simplifies maintenance and servicing of the aircraft, and is conducive to economies of scale in the manufacture to the device.

While simple ballasts have been previously used, even consisting of a single inductor, no ballasts are known, nor have come into commercial use, which feature the simplicity, light weight, compact size, and close load current regulation performance of the ballast of this invention.

More particularly, the ballast of this invention delivers regulated current from an A.C. power input to a fluorescent tube load which has a heater filament at each end. The fluorescent tube load may consist of one or more fluorescent tubes and may represent a lamp wattage load variable over a range of about three-to-one or better. Typically, the loads may vary from 14 W through 40 W, although this range may be readily extended at both the low and high ends.

The novel ballast in a basic form, has first and second inductors and first and second capacitors. One of the heater filaments of the load is connected between the first inductor and the first capacitor. Another heater filament at the opposite end of the load from the first filament is connected between the second inductor and the second capacitor. The first inductor is connected to the second capacitor at a first A.C. power input node, while the second inductor is connected to the first capacitor at a second A.C. power input node. In a preferred form of the invention, the heater filaments are connected in series with the inductors and capacitors, and are supplied with filament power by the bridge circuit. In an alternate form of the invention, the heater filaments are provided with filament current by a separate filament power supply independent of the bridge circuit.

The ballast circuit of this invention may be generally characterized as providing lamp load current regulation of at least plus or minus 20 percent over a range of lamp wattage loads of about three-to-one or greater. Such load current regulation is believed to be novel for a ballast having physically small and lightweight components as will be described in greater detail below. As a commercial reality, it is contemplated that the ballast of this invention is capable of delivering load current regulation of better than plus or minus 10 percent over a lamp wattage load range of 14 W through 40 W, and in fact has delivered regulation within plus or minus 2 percent over this range of loads.

The ballast of this invention may be constructed using a single, relatively small toroidal core for the inductors of the bridge circuit. In a preferred form of the invention, parallel capacitances and series inductances can be switched into and out of the bridge circuit to provide for high/low light output dimming capability, with a minimum of additional size and weight to the ballast.

One aspect of the invention is the installation of aircraft cabin fluorescent lighting, including multiple lamp fixtures, the lamp fixtures having different lamp wattage, the lamp wattage of the lamp fixtures having a range of about three-to-one or greater, the lamp fixtures over this range being equipped with the same ballast unit for supplying power to the fluorescent lamp tubes in each fixture. The same ballast unit is of uniform design and has the same value of inductance and capacitance components in each fixture. In particular, it is contemplated that different lamp fixtures having lamps rated from 14 W through 40 W throughout the aircraft cabin can be powered by the same ballast unit installed in each of the fixtures.

These and other improvements, advantages and features of the present invention will be better understood by reference to the following detail description of the preferred embodiments taken in conjunction with the accompanying drawings.

DETAILED DESCRIPTION OF THE PREFERRED EMBODIMENTS

Figure 1:
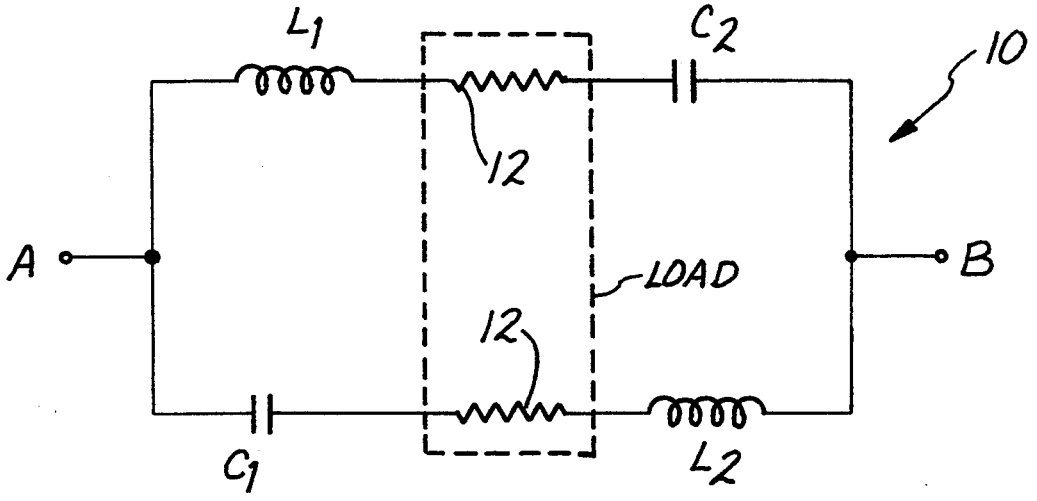
FIG. 1 is a schematic diagram showing a basic form of the novel ballast in its presently preferred configuration.

With reference to the attached drawings, FIG. 1 shows a presently preferred form of the ballast according to this invention, which is generally designated by the numeral 10. The ballast 10 drives a lamp load T which may consist of one or more fluorescent lamp tubes connected in series. The lamp load, whether a single lamp tube or several lamp tubes, has a heater filament 12 at each end of the load. The filaments shown as resistive elements in the drawings are the existing thermoionic electrodes conventionally provided in commercially available fluorescent lamp tubes. The filaments 12 require a current supply which is specified for each type of lamp tube by the manufacturer. The ballast circuit 10 is Configured as an inductance/capacitance bridge having two sets of inductances and capacitances, $L_1$, $C_1$, and $L_2$, $C_2$ connected across the lamp load T, and with the load filaments 12 connected in series between the two sets. The ballast 10 has power inputs A and B between the inductance and the capacitance of each set which are connected to a source of alternating current. Between the inputs A and B, the bridge circuit has two legs, each of which have an inductor in series with a capacitor. Each leg of the bridge circuit also includes one of the end filaments 12 connected in series between the inductor and capacitor of that leg. The position of the inductor and capacitor is reversed on the two legs, so that the upper leg in FIG. 1 has inductor L1 connected to power input A, and the lower leg of bridge has capacitor C1 connected to the same input. The upper leg has capacitor C2 connected to the other power input B and the lower leg has inductor L2 connected to the power input B. In an initial condition of the circuit 10 as power is first applied to inputs A, B, the lamp load T is unstruck and presents a high impedance between the filaments 12. In this starting condition, the two legs of the bridge $L_1$, $C_2$ and $C_1$, $L_2$ operate in a series resonant mode. The power flowing between inputs A and B in the series resonant tanks heats the lamp filaments 12 as required for rapid start operation of the lamp load T. The series resonant tanks L1, C2 and C1, L2, have voltages at the filaments 12 which are 180° out of phase with each other. This out of phase relationship of the voltage multiplies by two the fundamental voltage gain produced by series resonance, thus providing the higher starting voltage necessary to strike the lamp load. This feature of the bridge circuit makes unnecessary the use of a step-up transformer to achieve the open circuit striking voltage necessary to strike the lamp.

Upon striking of the lamp load T, the lamp impedance falls to a relatively low level, establishing a current path between the midpoints of the bridge legs. The new current path causes a shift in circuit operation to a predominantly parallel resonant mode where L1, C1 form a first parallel resonant tank, and C2, L2 form a second parallel resonant tank. The dominant current flow is a circulating current within each of the two tanks characteristic of parallel resonance. The parallel tanks share a common current path through the lamp load T, so that the two resonant current flows mesh in phase through the lamp load.

Start-up of the lamp load T requires filament current sufficient for rapid start of the lamp(s) T. Once the lamp load T is struck the filament current can be substantially reduced or even stopped without prejudicial effect on lamp operation. An advantageous feature of the ballast 10 is an inherent reduction of filament current through the lamp filaments 12 after striking of the lamp load. During the start-up phase with the ballast in series resonant mode the full current between the power inputs A and B flows through filaments 12, providing for rapid start of the lamp load. As the ballast 10 shifts to parallel resonant mode, the current flow through the filaments 12 drops to a low level. The result is extended filament life without need for additional ballast components to regulate filament current.

The selection of components values for L1, L2, C1, C2 must balance several operating characteristics of the ballast, including open circuit voltage necessary to initiate striking of the lamp load, the closed circuit lamp load current which must meet the requirements of the particular lamp or lamps, the load current regulation which should be within a desired tolerance over a desired range of lamp load wattage, the physical size of the components which should be as small as possible, the crest factor of the current waveform through the lamp load, the circuit Q which partly determines the open circuit voltage supplied by the ballast 10 for a particular resonant frequency of the L, C components, and the efficiency or power factor of the ballast circuit.

The design procedure for the ballast 10 will now be explained by way of the following Examples for a commercial passenger aircraft installation using FxxT12 series fluorescent lamps.

EXAMPLE 1

1) The desired range of lamp load wattage and the lamp type are specified. In this Example, the ballast is designed to power lamp loads ranging from 14 W through 40 W using commercially available FxxT12 series lamps. This range includes 40, 30, 20 and 14 Watt lamps.

2) A 115 Volt A.C. supply voltage to the ballast is chosen, which is the typical supply voltage used with FxxT12 series lamps. This supply voltage provides a good working margin above the specified operating voltage of 101 V for the largest lamp within the specified load range, the F40T12. This requirement is met by the 115 V/400 Hz power supply found on most passenger airliners.

3) A target load current is selected for the ballast sufficient to adequately power the different wattage lamps in the specified load range. The operating lamp load current specified by the manufacturer for the 40 and 30 watt rapid start lamps in the FxxT12 series is 430 mA, and 360 mA for the smaller 20 and 14 Watt lamps, which are of the preheat type. A target operating current to be supplied by the ballast is selected as 360 mA, which will adequately power the larger lamps and supply the rated current for the smaller lamps. While the light output of the larger lamps is somewhat reduced at the less-than-rated current, the lamp life is extended.

4) L and C selection is as follows:

a) An approximate average load impedance is calculated for the specified lamp load range. The impedance of each lamp load within the contemplated range of loads is approximated by dividing the lamp operating voltage by the lamp rated current. The average load impedance is then taken as a straight numerical average by adding the individual impedances of each contemplated lamp load and dividing by the number of different lamp loads under consideration:

| | | | |
|---|---|---|---|
| *F*40 | *T*12 | 235Ω | Ave = 167Ω |
| *F*30 | *T*12 | 179Ω | |
| *F*20 | *T*12 | 150Ω | |
| *F*14 | *T*12 | 105Ω | |

b) In order to achieve close regulation of the load current over a range of load impedances it is desirable to make the characteristic impedance of the ballast relatively high in relation to the lamp load impedance. It has been found that a characteristic ballast impedance which is twice the average load impedance yields satisfactory load current regulation. The characteristic impedance $Z_c$ of each LC leg of the bridge circuit 10 is therefore set at two times the calculated average load impedance.

c) The LC values are then obtained by first arbitrarily setting the value of L as high as practical, taking into consideration size and weight of the inductor. The large L reduces the value of the C component, which is desirable because capacitors rated for high currents are easier and less costly to obtain in smaller values.

For a typical value of L=120 mH, the value of C is $$L/Z_c^2=0.120/334^2=1.0\ \mu F$$

The calculated characteristic impedance of each LC leg is $Z_c=346$ ohms and has a resonant frequency $f_R=459$ Hz. This resonant frequency is above the power supply frequency of 400 Hz. The ballast resonant frequency must be spaced away from the power supply frequency to maintain current and voltage in the ballast and load at safe, non-destructive operating levels. As a first approximation in the design procedure, a spacing of about 100 Hz or more from the power line frequency has been found generally satisfactory. However, as evidenced in this Example, a greater or lesser spacing may work well also.

The load current regulation of the circuit 10 with the LC values derived above is then measured under normal operating conditions. For the circuit values derived above, the following load currents were obtained:

| | | |
|---|---|---|
| 40*W* | 351mA | 339mA avge., +3.5% −1.8% |
| 30*W* | 333mA | |
| 20*W* | 334mA | |
| 14*W* | 337mA | |

The average load current over the entire load range of 14 W through 40 W is 339 mA, and the load current regulation achieved was thus +3.5% −1.8%.

Where necessary, the resonant frequency $f_R$ can be moved closer or further from the supply frequency by appropriate adjustment of the LC values in order to obtain a correspondingly higher or lower open circuit voltage, i.e., the load striking voltage during the initial series resonant mode of operation of the ballast. Adjustment of the LC values alters the characteristic impedance $Z_c$ which in turn affects the load current regulation capability of the ballast. A number of iterations of this design procedure may be sometimes necessary before a satisfactory balancing of striking voltage, filament current and regulation performance is achieved.

EXAMPLE 2

Using the same lamp tube series and power supply as in Example 1, let L=240 mH and C=1.5 μF The characteristic impedance is then $$Z_c = \sqrt{\frac{.240}{1.5 \times 10^{-6}}} = 400\Omega$$

and the resonant frequency $f_R$=265 Hz. Current regulation measurements were made as in Example 1 and the following values obtained:

| | | |
|---|---|---|
| 40W | 335mA | 329mA avge., +2.4% −2.7% |
| 30W | 337mA | |
| 20W | 324mA | |
| 14W | 320mA | |

In this Example the resonant frequency is below the 400 Hz supply frequency and achieved excellent load current regulation. It may be found, however, that the crest factor of the current waveform delivered to the load can be improved by operating the ballast at a resonant frequency above the supply frequency.

EXAMPLE 3

Using the same lamp tube series and power supply as in Example 1, let L=84 mH and C=0.47 μF The characteristic impedance is then $$Z_c = \sqrt{\frac{.084}{.47 \times 10^{-6}}} = 423\Omega$$

and the resonant frequency $f_R$=801 Hz

Current regulation measurements were made as in Example 1 and the following values obtained:

| | | |
|---|---|---|
| 40W | 279mA | 324mA avge., +6.8% −14% |
| 30W | 325mA | |
| 20W | 346mA | |
| 14W | 345mA | |

As shown by the calculations in the foregoing Examples, the load current regulation of the ballast 10 can be optimized by adjustment of the LC values. The load current regulation achieved in Example 2 above, compares favorably to regulation obtainable with state of the art electronically regulated ballasts of much more complex design and with several times the number of components employed in the ballast of this invention.

The ballast 10 of this invention may be characterized as having a load current regulation of better than plus or minus 20% over a range of fluorescent lamp load wattage of at least 40 W through 14 W, a load range of about 3-to-1. Over this load range much closer load current regulation, within plus or minus 2% is in fact obtainable, and regulation of about 2.5% is demonstrated by the foregoing Examples. The lamp load wattage range can be readily extended and regulation comparable to that illustrated in the foregoing examples is readily achieved over a range of 8 W through 40 W. The high end of the load range may be extended as well, e.g. a load range of 14 W to 120 W, with load current regulation within the plus or minus 20 % regulation figure. The load regulation tolerances in the foregoing Examples assume a substantially constant supply voltage to the ballast 10, and the regulation tolerances would be somewhat degraded by fluctuations in the supply voltage. However, a primary application contemplated for this ballast is in aircraft lighting systems, where the supply voltage is typically well regulated and power supply fluctuations are not a significant concern.

An important and advantageous feature of the ballast of this invention is that both inductors L1 and L2 of ballast 10 are preferably wound on a single toroidal magnetic core. The size of the single core is no greater than would be required by either one of the inductors L1, L2 alone, resulting in substantial weight, size and parts count reduction for the ballast. Furthermore, the mutual inductance of inductors L1 and L2 on the common core permits the number of turns in each winding to be reduced over the turns which would be required in separated inductors, providing additional reduction of the physical size and weight. As a result, the parts count of the ballast 10 may be reduced to only three components, namely a single toroidal core carrying the two windings L1 and L2, and two relatively small capacitors C1 and C2. No magnetic type ballast is known offering comparable current regulation performance in such a small sized package and minimal component count.

Figure 2:
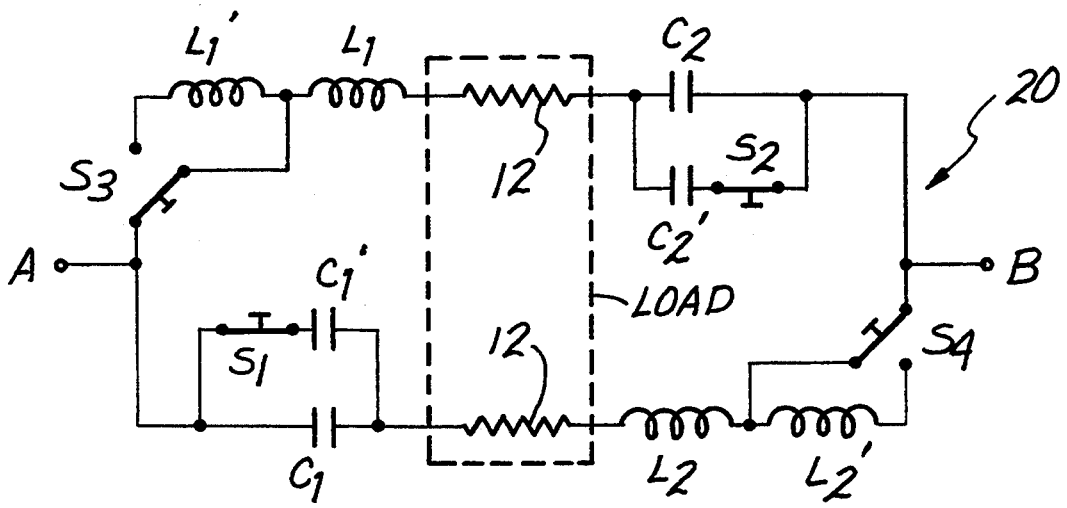
FIG. 2 shows the ballast of FIG. 1 adapted for switching the lamp load between high and low output levels.

In some lighting applications, it is desirable to provide for high/low switching of the lamp load, enabling the lamps to be dimmed from their full rated light output. A dimming capability is readily incorporated into the ballast of this invention as shown in the diagram of FIG. 2 by adding the LC components designated by primed lettering in ballast 20. Capacitors C1' and C2' are connected in parallel with capacitors C1 and C2 via switches S1 and S2, respectively. Inductors L1' and L2' are connected in series with inductors L1 and L2 via switches S3 and S4, respectively. All four switches S1 through S4 preferably are ganged as a four pole, double throw switch $S_{1\text{-}4}$. In a high illumination condition of the ballast circuit 20, switches S1 and S2 are closed while switches S3 and S4 are open. In this state of the circuit, the primed capacitors are connected in parallel while the primed inductors are disconnected and operatively removed from the circuit. The ballast 20 is switched to dimmed operation by actuating the switch $S_{1\text{-}4}$ so Chat switches S1 and S2 are opened, and S3, S4 are closed. In this dimmed condition of the circuit, the capacitances of the primed and unprimed components are no longer in parallel, reducing the effective capacitance in each resonant tank, while the primed and unprimed inductors are connected in series to increase the inductance in their corresponding resonant tanks. The net effect is that the characteristic impedance $Z_c$ of the ballast increases substantially, since $$Z_c = \sqrt{\frac{L}{C}},$$

causing a drop in current through the lamp load T, thereby reducing its light output.

It is important to note that the dimming feature is incorporated at little cost in size, weight, or component count All four coil windings, L1, L1', L2 , L2' can still be wound on a single toroidal core. The addition of the parallel capacitors C1', C2' and the four pole, double throw switch $S_{1-4}$ adds only three rather small and lightweight components to the basic ballast 10 of FIG. 1.

Figure 3:
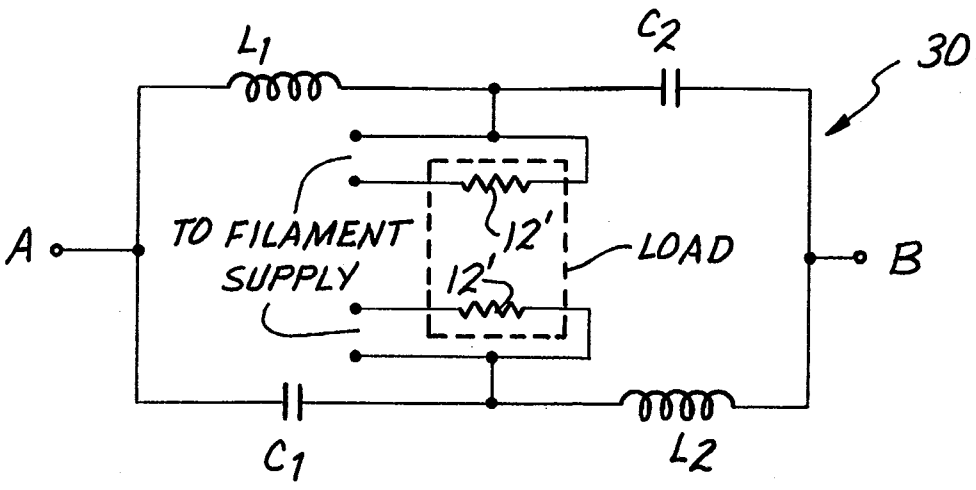
FIG. 3 shows an alternate form of the novel ballast.

In an alternative form of the invention shown in FIG. 3, the lamp load filaments 12' are connected to a filament power supply separate from the LC bridge. The filament supply may be of any suitable design and a particular circuit for the same is not shown in the drawings. One end of each filament 12' is connected to the LC bridge circuit at the same points as occupied by the filaments 12' in the circuits of FIGS. 1 and 2, i.e., between the LC element of each leg of the bridge circuit. While the filaments 12' are no longer in series with the LC elements on each side of the bridge, the lamp load impedance nevertheless remains connected as before across the two legs of the bridge circuit. As before, the lamp load impedance prior to striking represents essentially an open circuit and the ballast operates in a series resonant mode. After striking, the lamp load carries a current and its impedance becomes relatively low, causing the ballast circuit 30 to operate in a predominantly parallel resonant mode, as has been described in connection with the circuit of FIG. 1. Such a separate filament supply may be desirable in applications where the ballast is to be used in low temperature environments, near freezing or below. In order to assure starting of the lamp load under such conditions, it may be desirable to provide a higher voltage and current supply to the filaments than is readily provided in the circuits of FIG. 1 and 2. Also, if it is desired to operate the lamp load in extreme dim mode it may be necessary to provide a filament current which cannot be derived from the resonant circuits of the ballast in such mode of operation. In such special applications, the additional size, weight, and cost of the separate filament supply are justified. The design and performance of the ballast 30, insofar as concerns current regulation over a range of lamp wattage loads, is the same as has been described in connection with FIG. 1. Further, the ballast 30 can also be equipped with dimming capability in the same manner as has been described in connection with FIG. 2.

Figure 4:
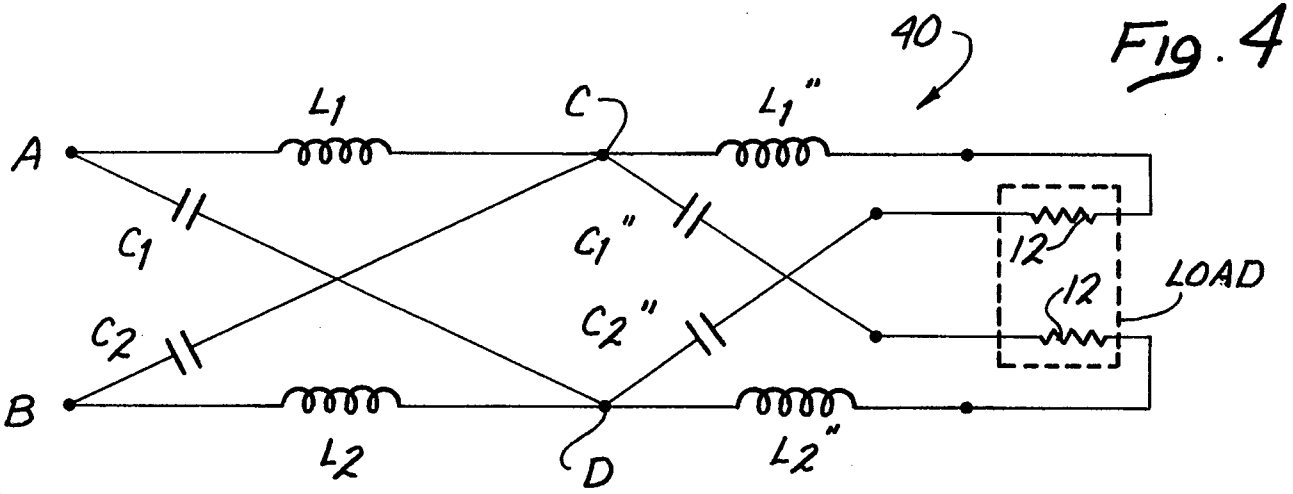
FIG. 4 shows a two stage ballast in which two bridge circuits, each similar to the ballast shown in Figure, have been cascaded.

FIG. 4 shows a two stage ballast circuit 40, in which two stages, each similar to the circuit 10 of FIG. 1 have been cascaded. The first stage consisting of the unprimed components L1, L2, C1, C2 is connected to a source of A.C. power at its power inputs A and B. The output of the first stage is connected to the input of the second stage at nodes C and D. The second stage of the ballast 40 consists of the double primed components L1'', L2'', C1'' and C2'', and is connected to a fluorescent lamp load as shown, with the end filaments 12 each connected between the inductor and capacitor of one leg of the second stage bridge circuit, as in the single stage ballast of FIG. 1.

It has been found that by cascading the bridge circuits in this manner, the crest factor of the current waveform delivered to the load can be improved i.e., a smoother current waveform may be obtained. The values of the inductors and capacitors having like subscript numerals in FIG. 4 may be the same, and the values of the components may be derived as has been described and explained above in connection with the circuit of FIG. 1.

While certain preferred embodiments of the invention have been described and illustrated for purposes of clarity and example, it must be understood that many changes, substitutions, and modifications to the described embodiments will become obvious to those possessed of ordinary skill in the art without their thereby departing from the scope and spirit of the present invention which is defined by the following claims.

What is claimed is:

1. A ballast for delivering a substantially constant current to a fluorescent tube load variable by a factor of at least 3-to-1 between the lowest and highest wattage rating of said load, said fluorescent tubes having heater filaments at opposite ends of said tubes, comprising:

a bridge circuit having first and second inductors and first and second capacitors, a first said heater filament connected between said first inductor and said first capacitor, a second said heater filament connected between said second inductor and said second capacitor, said first inductor being connected to said second capacitor at a first input node, said second inductor being connected to said first capacitor at a second input node.

2. A ballast for delivering a substantially constant A.C. current to a load consisting of one or more fluorescent tube lamps of similar wattage connected in series, each of said lamps having a rated current, said load having electrodes at opposite ends, comprising:

a bridge circuit having first and second inductors and first and second capacitors, a first said electrode connected to said first inductor and said first capacitor at a first output node, a second said electrode connected to said second inductor and said second capacitor at a second output node, said first inductor being connected to said second capacitor at a first input node, said second inductor being connected to said first capacitor at a second input node, said inductors and capacitors being selected for delivering approximately said rated current through said load substantially independently of the number of said lamps in said load up to a maximum number not smaller than three said lamps, there being no substantial ballasting impedance between the output nodes and said electrodes.

3. The ballast of claim 2 further comprising means for connecting a shunt capacitor across each of said capacitors and a series inductor with each of said inductors for selectively setting the current delivered by said bridge to said load by actuation of said means.

4. The ballast of claim 3 wherein said first and second inductors and said series inductors are wound on a common magnetic core.

5. The ballast of claim 3 wherein said regulated A.C. current is constant to within plus or minus 20 percent for any number of said lamps in said load up to said maximum number.

6. The ballast of claim 1 further comprising switch means for selectively connecting a shunt capacitor across each of said capacitors and a series inductor with each of said inductors for switching between a high and a low current delivered by said bridge circuit to said load by actuation of said switch means.

7. The ballast of claim 6 wherein said first and second inductors and said series inductors are wound on a common magnetic core.

8. The ballast of claim 2 wherein said A.C. current has a characteristic frequency and said inductors and capacitors are selected to have a series resonant frequency near but not equal to said characteristic frequency.

9. The ballast of claim 1 wherein said range includes loads from approximately 14 W to 80 W and said regulated A.C. current is regulated to within plus or minus 20 percent over said range.

10. A ballast for delivering regulated A.C. current from an A.C. power input to a fluorescent tube load, said fluorescent tube load having a heater filament at each end, comprising:

a bridge circuit having first and second inductors and first and second capacitors, said first inductor being connected to said second capacitor at a first A.C. input node, said second inductor being connected to said first capacitor at a second A.C. input node said first and second inductors being wound on a common toroidal magnetic core.

11. The ballast of claim 10 further comprising switch means for selectively connecting a shunt capacitor across each of said capacitors and a series inductor with each of said inductors for switching between a high and a low current delivered by said bridge circuit to said load by actuation of said means, wherein said first and second inductors each have a magnetic core common with a corresponding said series inductor.

12. A ballast for delivering A.C. load current from an A.C. power input to a fluorescent tube wattage load comprising:

a bridge circuit having first and second inductors and first and second capacitors, said first inductor being connected to said second capacitor at a first A.C. input node, said second inductor being connected to said first capacitor at a second A.C. input node characterized in that said inductors and said capacitors have values selected for regulating said A.C. load current to within plus or minus 10% to a said fluorescent tube wattage load ranging from 14 Watt to at least 40 Watt.

13. A ballast for delivering regulated A.C. current from an A.C. power input to a fluorescent tube load, said fluorescent tube load having a heater filament at each end, comprising:

a bridge circuit having first and second inductors and first and second capacitors, said load having first and second input electrodes, one of said electrodes being connected between said first inductor and said first capacitor, the other of said input electrodes being connected between said second inductor and said second capacitor, said first inductor being connected to said second capacitor at a first A.C. input node, said second inductor being connected to said first capacitor at a second A.C. input node, switch means for selectively connecting a shunt capacitor across each of said capacitors and an inductor in series with each of said inductors for switching between a high and a low current delivered by said bridge to said load by actuation of said means, wherein said first and second inductors each have a magnetic core common with a corresponding said series inductor.

14. In an aircraft having a cabin and a plurality of fluorescent lamp fixtures in said cabin, each of said lamp fixtures having a ballast connected for supplying power to a fluorescent lamp load in the fixture, different ones of said fixtures having lamp wattage differing by a factor of about 3-to-1 or greater, the improvement wherein said ballast in each of said lamp fixtures comprises a bridge circuit having first and second inductors and first and second capacitors, said first inductor being connected to said second capacitor at a first power input node, said second inductor being connected to said first capacitor at a second power input node, said first inductor being connected to said first capacitor at a first output node, said second inductor being connected to said second capacitor at a second output node, said lamp load being connected between said first and second output nodes, said first and second inductors and said first and second capacitors being of similar values in each of said fixtures.

15. In an aircraft having a cabin and a plurality of fluorescent lamp fixtures in said cabin, said lamp fixtures ranging in lamp wattage from at least 14 watt to at least 40 watt, each of said lamp fixtures having a ballast connected for supplying power to said lamp wattage, the improvement wherein said ballast in each of said lamp fixtures comprises a bridge circuit having first and second inductors and first and second capacitors, said first inductor being connected to said second capacitor at a first power input node, said second inductor being connected to said first capacitor at a second power input node, said first inductor being connected to said first capacitor at a first output node, said second inductor being connected to said second capacitor at a second output node, said lamp load being connected between said first and second output nodes, said first and second inductors and said first and second capacitors being of similar values in each of said fixtures.

16. The ballast of claim 1 wherein said first inductor and said second inductor are wound on a common toroidal magnetic core.

17. The ballast of claim 2 wherein said first inductor and said second inductor are wound on a common toroidal magnetic core.

18. The ballast of claim 2 characterized in that said inductors and said capacitors have values selected for regulating said A.C. load current to within plus or minus 10% to a said load of fluorescent lamp tubes ranging from 14 Watt to at least 40 Watt.

19. The ballast of claim 12 wherein said first inductor and said second inductor are wound on a common toroidal magnetic core.

20. The ballast of claim 14 wherein said first and second inductors in each of said fixtures are wound on a common toroidal magnetic core.

21. The ballast of claim 14 wherein at least some of said fixtures have switch means actuatable for altering the effective impedances of both said inductors and said capacitors in said bridge circuit for changing the light output of said fluorescent lamp load.

22. A ballast for delivering regulated A.C. current from an A.C. power input of given frequency to a fluorescent tube load, said fluorescent tube load having a heater filament at each end, comprising:

a bridge circuit having first and second inductors and first and second capacitors, said first inductor being connected to said second capacitor at a first A.C. input node, said second inductor being connected to said first capacitor at a second A.C. input node, said first inductor being connected to said first capacitor at a first output node, said second inductor being connected to said second capacitor at a second output node, said lamp load being connected between said first and second output nodes, each inductor being selected to resonate in series with a said capacitor at a frequency near but not equal to said given frequency of the A.C. power supply.

23. The ballast of claim 22 further comprising switch means actuatable for altering the effective impedances of both said inductors and said capacitors in said bridge circuit for changing the light output of said fluorescent lamp load.

* * * * *